US005570471A

United States Patent [19]

Krawchuk

[11] Patent Number: 5,570,471

[45] Date of Patent: Nov. 5, 1996

[54] GARMENT SHIELD

[76] Inventor: Leesa C. Krawchuk, 2811 Newton Ave. North, Minneapolis, Minn. 55411

[21] Appl. No.: 400,378

[22] Filed: Mar. 8, 1995

[51] Int. Cl.[6] ..... A41D 27/13

[52] U.S. Cl. ..... 2/53; 2/54; 2/56; 2/46

[58] Field of Search ..... 2/53, 54, 55, 56, 2/57, 58, 115, 113, 46, 48, 49.1, 49.2, 49.3, 49.4, 49.5, 50, 51, 52, 104, 105, 106; 450/86

[56] References Cited

U.S. PATENT DOCUMENTS

| | | | |
|---|---|---|---|
| 223,621 | 1/1880 | Williams | 2/55 |
| 361,494 | 4/1887 | Dewey | 2/55 |
| 374,840 | 11/1887 | Campbell | 2/55 |
| 498,801 | 6/1893 | Lester | 2/55 |
| 498,877 | 6/1893 | Bulter | 2/56 |
| 519,487 | 5/1894 | Warner | 2/56 |
| 542,991 | 7/1895 | Crout | 2/55 |
| 715,743 | 12/1902 | Basch | 2/55 |
| 847,241 | 3/1907 | Cochran | 2/55 |
| 887,454 | 5/1908 | Basch | 2/55 |
| 2,238,466 | 4/1941 | Gardner | 2/54 |
| 3,145,391 | 8/1964 | Tyrell, Jr. | 2/56 |
| 3,474,465 | 10/1969 | Artzt | 2/113 |
| 3,588,916 | 6/1971 | Glatt | 2/53 |
| 3,727,237 | 4/1973 | Glatt | 2/56 |
| 4,454,080 | 10/1985 | Gorham | 2/54 |
| 4,856,111 | 8/1989 | Sholes | 2/56 |
| 5,245,707 | 9/1993 | Green | 2/54 |

FOREIGN PATENT DOCUMENTS

| | | | |
|---|---|---|---|
| 13932 | 7/1899 | United Kingdom | 2/53 |

*Primary Examiner*—Jeanette E. Chapman
*Attorney, Agent, or Firm*—Westman, Champlin & Kelly, P.A.

[57] ABSTRACT

A garment shield is provided for attaching to a garment having a garment front torso section, a garment rear torso section and a garment sleeve section which are secured together along a sleeve seam line. The garment shield includes a shield seam line, a shield torso section and a shield sleeve section. The shield seam line conforms with the sleeve seam line. The shield torso section includes a front panel, a rear panel and a lower panel which extend from the shield seam line over a portion of the garment front and rear torso sections. The shield sleeve section includes a front panel, a rear panel and a lower panel which are stitched along the shield seam line to the front, rear and lower panels of the shield torso section, respectively. The front, rear and lower panels of the shield sleeve section extend from the shield seam line over a portion of the garment sleeve section. The shield torso section and the shield sleeve section have preformed patterns along the shield seam line such that when the shield sleeve section is stitched to the shield torso section, the shield sleeve section and the shield torso section lie generally flat along a contour of the garment sleeve and torso sections. An adhesive is attached to the shield torso section and the shield sleeve section for temporary attachment to the garment.

9 Claims, 4 Drawing Sheets

GARMENT SHIELD

BACKGROUND OF THE INVENTION

The present invention relates to clothing accessories and, in particular, to a garment shield for protecting a garments from underarm perspiration.

Underarm perspiration causes garments to become soiled during use, which requires garments to be cleaned frequently. If a garment is worn in direct contact with the skin, such as when worn with a sleeveless blouse, deodorant from the wearer's underarm can also soil the garment during use. If the garment requires dry cleaning, frequent cleaning can become particularly expensive. Also, cleaning does not always completely remove the soiling effects of perspiration and deodorant. After long periods of use, garments eventually become permanently soiled or stained and must be replaced.

Garment shields have been used in the prior art to protect garments from underarm perspiration. However, the garment shields of the prior art do not completely cover the perspiration area and do not adequately conform to garments. As a result, the shields have a tendency to become dislodged during use or cause the garments in which they are used to become distorted or bunched. This makes the shields uncomfortable to wear and noticeable from the exterior of the garments.

SUMMARY OF THE INVENTION

The present invention is a garment shield for attaching to a garment having a garment front torso section, a garment rear torso section and a garment sleeve section which are secured together along a sleeve seam line. The garment shield includes a shield seam line, a shield torso section and a shield sleeve section. The shield seam line conforms with the sleeve seam line. The shield torso section includes a front panel, a rear panel and a lower panel which extend from the shield seam line over a portion of the garment front and rear torso sections. The shield sleeve section includes a front panel, a rear panel and a lower panel which are stitched along the shield seam line to the front, rear and lower panels of the shield torso section, respectively. The front, rear and lower panels of the shield sleeve section extend from the shield seam line over a portion of the garment sleeve section. The shield torso section and the shield sleeve section have preformed patterns along the shield seam line such that when the shield sleeve section is stitched to the shield torso section, the shield sleeve section and the shield torso section lie generally along a contour of the garment sleeve and torso sections. An adhesive is attached to the shield torso section and the shield sleeve section for temporary attachment to the garment.

In one embodiment, the shield seam line extends along at least 50 percent of the sleeve seam line. As a result, the garment shield protects front and rear arm perspiration areas as well as lower arm perspiration areas. The shield torso section and the shield sleeve section have a fabric grain that is oriented such that the shield torso section and the shield sleeve section are stretchable in a lateral direction, generally from the garment front torso section toward the garment rear torso section. This allows the garment shield to conform to the contour of the garment and to stretch with the garment during torso and arm movements.

The shield torso section and the shield sleeve section include a porous, dry weave layer and a first absorptive layer. The first absorptive layer is positioned between the dry weave layer and the garment. The garment shield can also include a second absorptive layer which is attached to the first absorptive layer and is stitched along the shield seam line. The second absorptive layer covers a portion of the lower panels of the shield torso and shield sleeve sections to provide additional absorption in the lower armpit area.

The adhesive preferably includes one or more adhesive strips with a protective backing. It has been found that spacing the adhesive strips at least one-half to three-quarters inch from the periphery of the garment shield allows the garment shield to lie flat against the garment and avoid bunching. The garment shield is attached to the garment by removing the protective backing to expose the adhesive strips and pressing the garment shield gently about the sleeve seam line. The garment shield can be replaced or repositioned by simply detaching the adhesive strips from the garment.

DETAILED DESCRIPTION OF THE PREFERRED EMBODIMENTS

Figure 1:
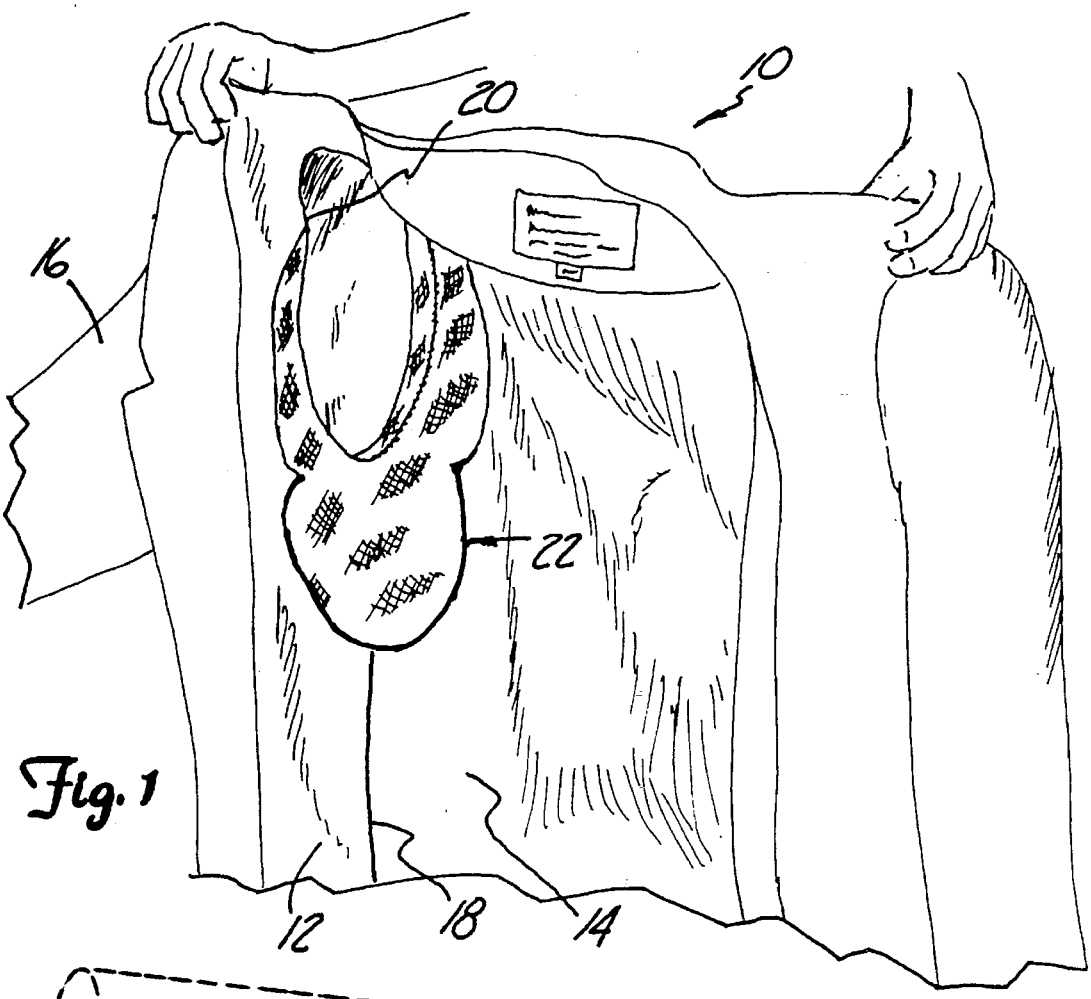
FIG. 1 is a perspective view of a garment shield secured to a garment, in accordance with the present invention.

FIG. 1 is a perspective view of a garment shield attached to a garment in accordance with the present invention. Garment 10 includes a front torso section 12, a rear torso section 14 and a sleeve section 16. Front torso section 12 and rear torso section 14 are secured together along a seam line 18. Front torso section 12 and rear torso section 14 are also secured to sleeve section 16 along sleeve seam line 20.

A garment shield 22 is temporarily attached to garment 10 about sleeve seam line 20. As described in greater detail below, garment shield 22 conforms to the contour of garment 10 and does not allow garment 10 to become distorted or bunched. As a result, garment shield 22 is comfortable to wear and is not detectable from the exterior of garment 10 during use.

Figure 2:
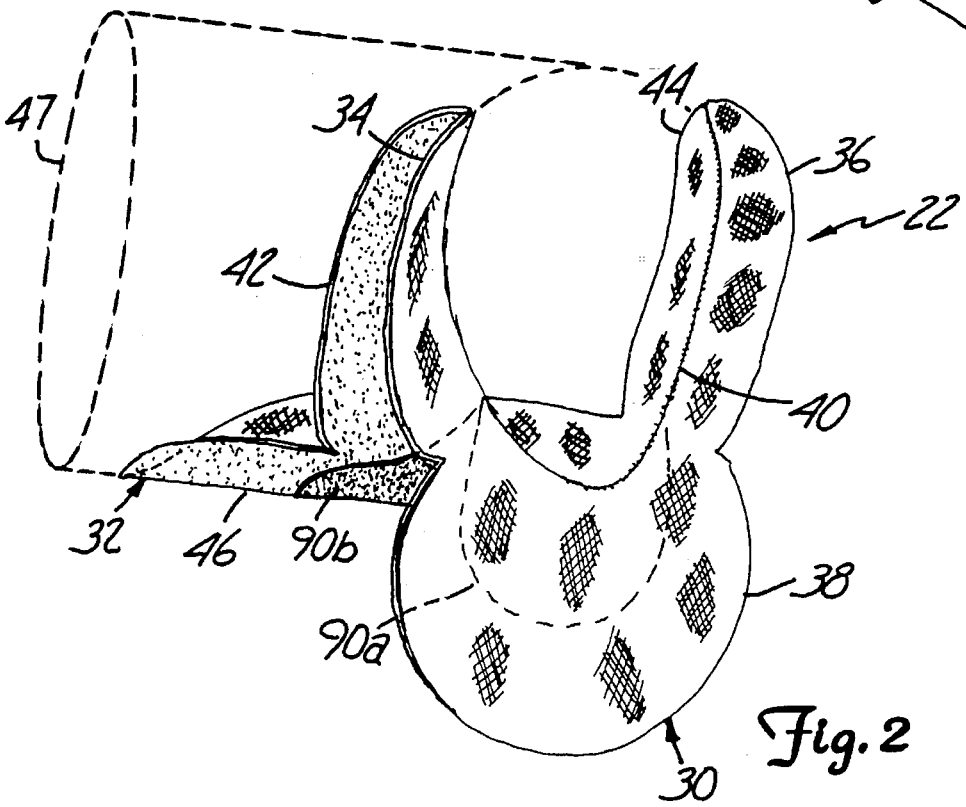
FIG. 2 is a perspective view of the garment shield shown in FIG. 1.

FIG. 2 is a perspective view of garment shield 22, which has been removed from garment 10. Garment shield 22 includes a shield torso section 30 and a shield sleeve section 32. Shield torso section 30 includes a front panel 34, a rear panel 36 and a lower panel 38. Front panel 34, rear panel 36 and lower panel 38 extend from a shield seam line 40 over a portion of garment front section 12 and garment rear section 14 (shown in FIG. 1). In a preferred embodiment, front and rear panels 34 and 36 are approximately ½ to 2 inches wide. Lower panel 38 has a generally circular shape and extends approximately 4–5 inches from shield seam line 40.

Shield sleeve section 32 includes a front panel 42, a rear panel 44 and a lower panel 46 which are stitched along shield seam line 40 to front panel 34, rear panel 36 and lower panel 38, respectively, of shield torso section 30. In one embodiment, front panel 42 and rear panel 44 are approximately ½ to 2 inches wide. Lower panel 46 is similar to lower panel 38, and extends from shield seam line 40 about 4–5 inches.

Shield torso section 30 and shield sleeve section 32 have preformed patterns along shield seam line 40 such that when the shield torso section is stitched to the shield sleeve section, shield seam line 40 conforms with sleeve seam line 20 of garment 10. Front panel 34, rear panel 36 and lower panel 38 of shield torso section 30 lie generally flat along a contour of garment front and rear torso sections 12 and 14. Front panel 42, rear panel 44 and lower panel 46 of shield sleeve section 32 form a partial cylindrical surface 47 which generally follows a contour of garment sleeve section 16.

Shield seam line 40 preferably extends along at least 50 percent of sleeve seam line 20, and most preferably between about 75–90 percent of sleeve seam line 20 so that the garment shield protects the front and rear arm perspiration areas as well as lower arm perspiration areas. The front and rear panels protect both the torso and sleeve sections of the garment.

Figure 3:
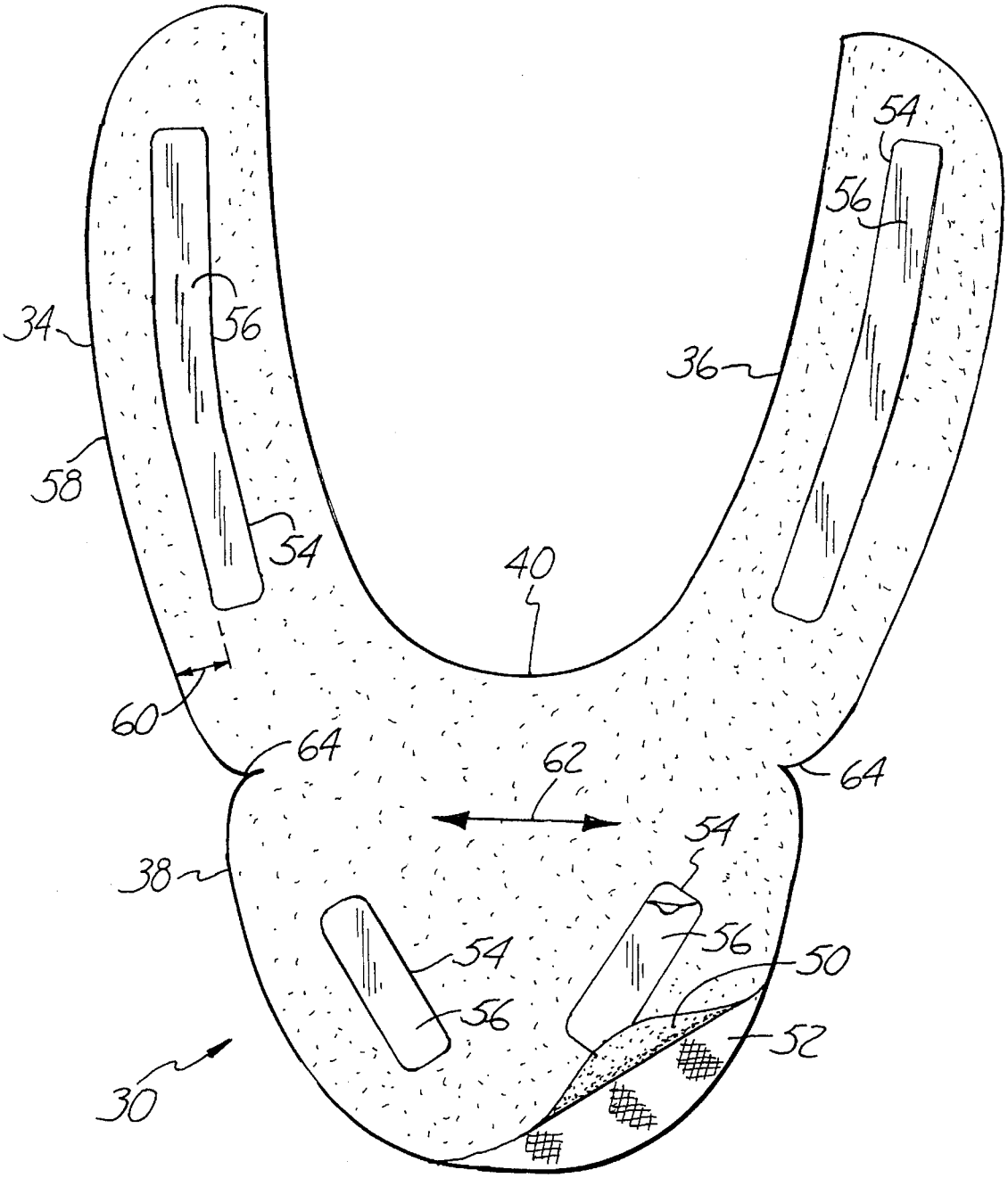
FIG. 3 is a top plan view of a shield torso section pattern piece.

FIG. 3 is a top plan view of shield torso section 30 as a pattern piece before being stitched to shield sleeve section 30. Shield torso section 30 includes front panel 34, rear panel 36 and lower panel 38. Shield torso section 30 has two layers, an absorptive layer 50 and a porous, dry weave layer 52. Absorptive layer 50 faces garment 10 (FIG. 1). Absorptive layer 50 includes one or more layers of nonirritating, non-allergenic, absorbent material which can include, but is not restricted to, paper, cotton or synthetic fibers. Examples of suitable absorbent material are available from Kimberly-Clark Corporation. Absorptive layer 50 can be treated with a fragrance, a deodorizing agent or a moisture absorber such as baking soda or powder.

Porous, dry weave layer 52 faces the wearer of the garment. Porous, dry weave layer 52 is a moisture-resistant liner which helps keep the wearer dry while allowing perspiration to be absorbed by absorptive layer 50. An example of a suitable non-woven dry weave material is also available from Kimberly-Clark Corporation.

Shield torso section 30 is attached to garment 10 (shown in FIG. 1) by one or more adhesive strips 54. Adhesive strips 54 include a protective backing 56. Backing 56 is peeled off the adhesive strips to expose the adhesive prior to attaching the shield to the garment. Adhesive strips 54 are spaced from a periphery 58 of the shield by a distance 60 which is at least one-half inch. In a preferred embodiment, distance 60 is at least three-quarters of an inch. It has been found that spacing the adhesive strips from periphery 58 results in a smoother appearance outside the garment as well as inside the garment. The shield lies flat on the garment and does not allow the garment to become distorted or bunched.

The fabric used to construct shield torso section 30 has a fabric grain that is oriented such that the shield torso section is stretchable in a lateral direction 62. The fabric grain is perpendicular to the stretch direction in most fabrics. Direction 62 extends generally from garment front section 12 toward garment rear section 14, and is generally tangential to shield seam line 40 at lower panel 38. This orientation matches a typical stretch direction in the garment. Shield torso section 30 therefore lies flat along the contour of the garment after being stitched to shield sleeve 32.

Shield torso section 30 includes one or more indentations or cut-outs by which provide strain relief when the shield torso section is stitched to shield sleeve section 32. The strain relief assists in allowing the shield torso section to lie flat along the contour of the garment.

Figure 4:
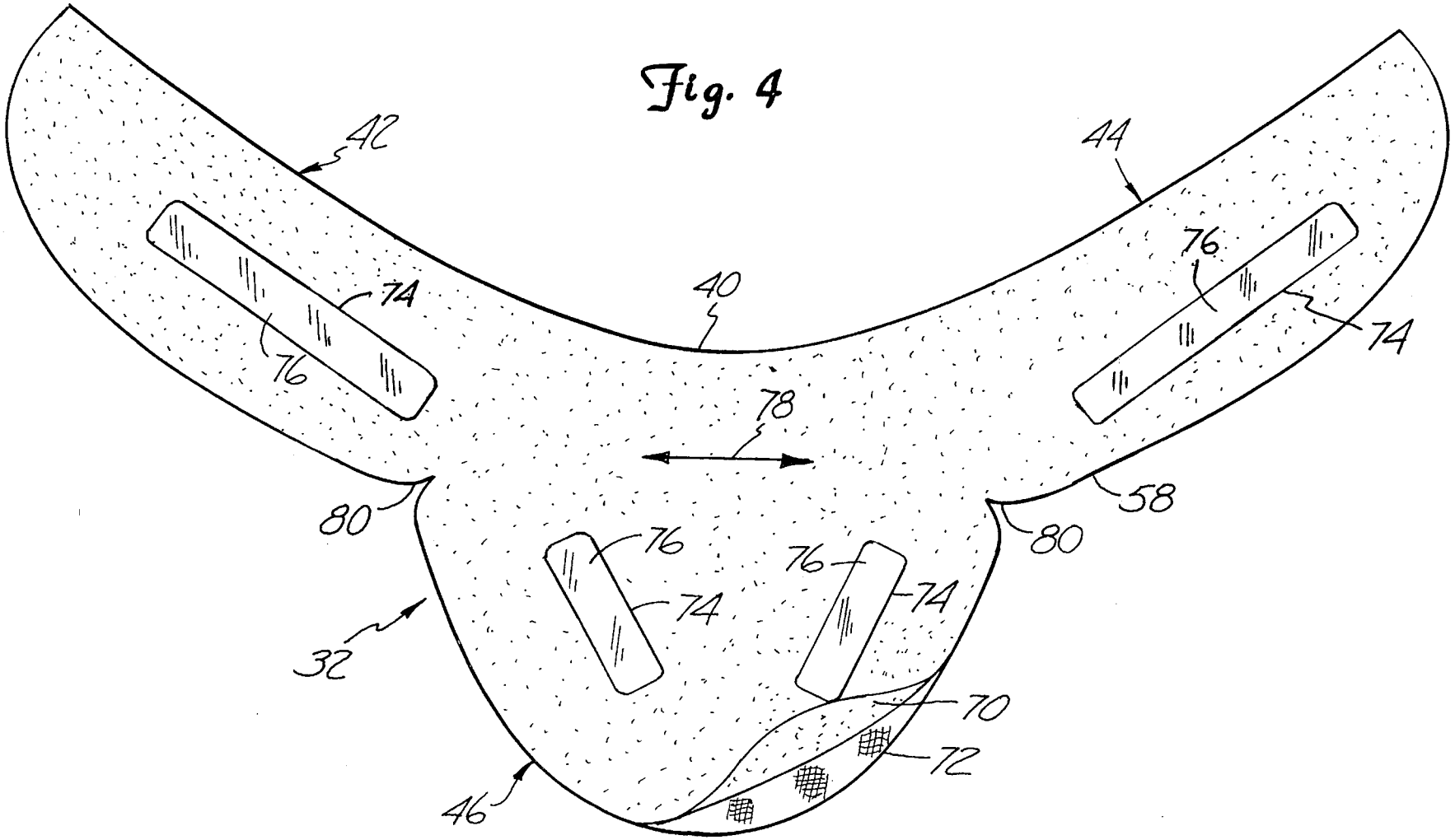
FIG. 4 is a top plan view of a shield sleeve section pattern piece.

FIG. 4 is a top plan view of a shield sleeve section 32 as a pattern piece before being stitched to shield torso section 30. Shield sleeve section 32 includes front panel 42, rear panel 44 and lower panel 46. Front panel 42, rear panel 44 and lower panel 46 are stitched along shield seam line 40 to front panel 34, rear panel 36 and lower panel 38, respectively, of shield torso section 30 (FIG. 3).

Shield sleeve section 32 also has two layers, including an absorptive layer 70 and a porous, dry weave layer 72. Absorptive layer 70 and porous, dry weave layer 72 are similar to absorptive layer 50 and porous, dry weave layer 52 of shield torso section 30. Shield sleeve section 32 also includes one or more adhesive strips 74 having protective backings 76. Adhesive strips 74 are preferably spaced from periphery 58 by a distance that is at least one-half inch.

Like shield torso section 30, shield sleeve section 32 has a fabric grain which is oriented such that the shield sleeve section is stretchable in a direction 78, which is generally from garment front section 12 toward garment rear section 14 (FIG. 1). Since lower panel 46 is stretchable along direction 78, lower panel 46 stretches in a direction that is parallel to a typical stretch direction in garment sleeve section 16 and allows lower panel 46 to follow the contour of garment sleeve section 16 when stretched after attachment to shield torso section 30.

Shield sleeve section 32 includes one or more indentations or cut-outs 80 which provide additional strain relief after the shield sleeve section is stitched to shield torso section 30. This strain relief allows shield sleeve section 32 to lie flat along the contour of garment 10.

Figure 5:
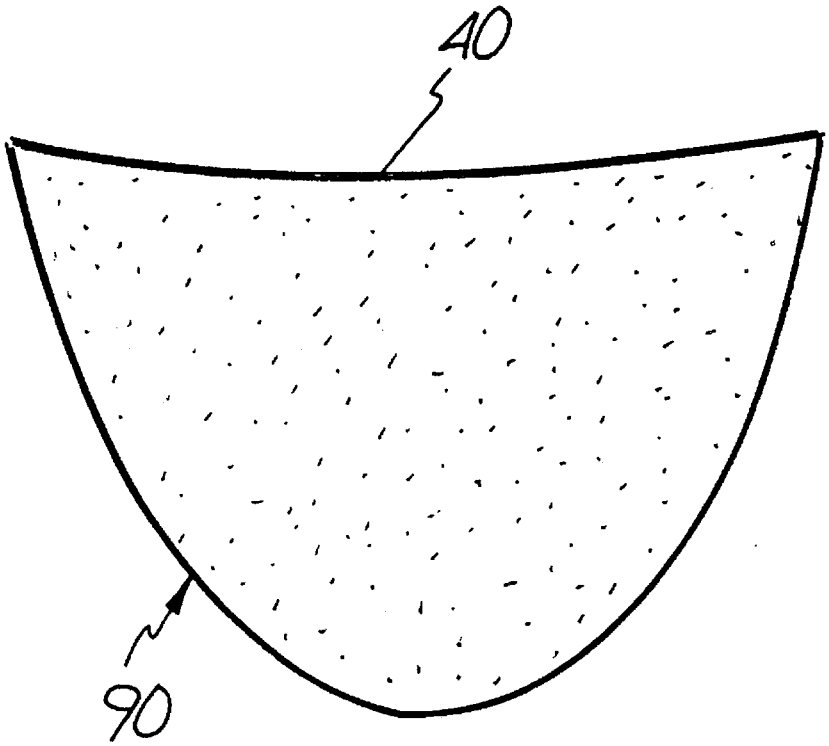
FIG. 5 is a top plan view of an additional absorptive layer pattern piece.

FIG. 5 is a top plan view of a center piece 90 which is formed of an absorptive material, similar to absorptive layers 50 and 70, shown in FIGS. 3 and 4. In the embodiment shown in FIG. 2, garment shield 22 includes two center pieces 90 with a first center piece **90*a* attached to shield torso section 30 and a second center piece 90*b* attached to shield sleeve section 32. The center pieces are attached to lower panels 38 and 46, along shield seam line 40 to provide an additional absorptive layer in the lower armpit area. The lower armpit area is the area which generates the most amount of perspiration. Center pieces 90*a* and 90*b* have surface areas which are less than the surface area of lower panels 38 and 46. The smaller surface areas provide a grated profile which allows the lower panels to lie flat along the contour of garment 10** but provide sufficient additional absorptive capacity in the area in which it is most needed.

The contour of the garment shield of the present invention allows the shield to fit into the garment very comfortably, without allowing the garment to become distorted or bunched. As a result, the garment shield is not noticeable from the exterior of the garment. The garment shield protects the garment from front and rear arm perspiration areas as well as lower arm perspiration areas. This provides a significant advantage since underarm perspiration is not limited to the lower armpit area only.

The garment shield of the present invention is effective but inconspicuous due to its light weight and noiseless materials. The different layers preferably have varied flexibility to minimize premature tearing, particularly when the shield becomes soiled. The garment shield can be made in a variety of colors and sizes to match different garments. The garment shield can be replaced or repositioned by simply detaching the adhesive strips from the garment.

Although the present invention has been described with reference to preferred embodiments, workers skilled in the art will recognize that changes may be made in form and detail without departing from the spirit and scope of the invention.

What is claimed is:

1. A garment shield comprising:

a shield seam line;

a shield torso section including a front panel, a rear panel and a lower panel which extend from the shield seam line;

a shield sleeve section including a front panel, a rear panel and a lower panel which are stitched along the shield seam line to the front, rear and lower panels of the shield torso section, respectively, and which extend from the shield seam line;

wherein the lower panels of the shield torso section and the shield sleeve section have a radius of curvature along the shield seam line such that when the shield sleeve section is attached to the shield torso section, the front, rear and lower panels of the shield sleeve section form a partial cylindrical surface;

wherein the shield torso section and the shield sleeve section have a fabric grain that is oriented such that the shield torso section and the shield sleeve section are stretchable in a lateral direction generally from the front panel of the shield torso section toward the rear panel of the shield torso section;

wherein the shield torso section and the shield sleeve section include a first absorptive layer, a second absorptive layer and a porous, dry weave layer, with the first absorptive layer being positioned between the porous, dry weave layer and the second absorptive layer, and wherein the lower panels have a surface area and the second absorptive layer has a surface area that is less than the surface area of the lower panels; and an adhesive which is attached to the porous, dry weave layer of the shield torso section and the shield sleeve section.

2. The garment shield of claim 1 wherein the shield seam line forms a partial ring which is at least 75 percent closed.

3. The garment shield of claim 1 wherein:

the front panel, rear panel and lower panel of the shield torso section extend from the shield seam line at least one-half inch; and the front panel, rear panel and lower panel of the shield sleeve section extend from the shield seam line at least one-half inch.

4. The garment shield of claim 1 and further comprising a periphery, wherein the adhesive is attached to the shield torso section and the shield sleeve section at least ¾ inch from the periphery.

5. The garment shield of claim 1 wherein the radius of curvature of the lower panel of the shield sleeve section is greater than the radius of curvature of the lower panel of the shield torso section.

6. A garment shield comprising:

a periphery;

a shield seam line;

a shield torso section including a front panel, a rear panel and a lower panel which extend from the shield seam line at least one-half inch;

shield sleeve section including a front panel, a rear panel and a lower panel which are attached along the shield seam line to the front, rear and lower panels of the shield torso section, respectively, wherein the front, rear and lower panels of the shield sleeve section extend from the shield seam line at least one-half inch;

wherein the shield torso section and the shield sleeve section have a fabric grain that is oriented such that the shield torso section and the shield sleeve section are stretchable in a lateral direction generally from the front panel of the shield torso section toward the rear panel of the shield torso section;

wherein the shield torso section and the shield sleeve section include a first absorptive layer, a second absorptive layer and a porous, dry weave layer, with the first absorptive layer being positioned between the porous, dry weave layer and the second absorptive layer, and wherein the lower panels have a surface area and the second absorptive layer has a surface area that is less than the surface area of the lower panels; and an adhesive which is attached to the porous, dry weave layer of the shield torso section and the shield sleeve section.

7. The garment shield of claim 6 wherein the shield seam line forms a partial ring which is at least 75 percent closed.

8. The garment shield of claim 6 wherein the lower panel of the shield torso section has a radius of curvature along the shield seam line and the shield sleeve section has a radius of curvature along the shield seam line such that when the shield sleeve section is stitched to the shield torso section, the front, rear and lower panels of the shield sleeve section form a partial cylindrical surface.

9. The garment shield of claim 8 wherein the radius of curvature of the shield sleeve section is greater than the radius of curvature of the shield torso section.

* * * * *

UNITED STATES PATENT AND TRADEMARK OFFICE

CERTIFICATE OF CORRECTION

PATENT NO. : 5,570,471
DATED : November 5, 1996
INVENTOR(S) : Leesa C. Krawchuk

It is certified that error appears in the above-indentified patent and that said Letters Patent is hereby corrected as shown below:

TITLE PAGE

Under [56] References Cited:

Please delete "374,840" and insert --374,040--.

Col. 6, line 12, please insert --a-- before "shield".

Signed and Sealed this

Eighteenth Day of March, 1997

Bruce Lehman

*Attest:*

BRUCE LEHMAN

*Attesting Officer*

*Commissioner of Patents and Trademarks*